US012698900B2

(12) United States Patent
Beran et al.

(10) Patent No.: US 12,698,900 B2
(45) Date of Patent: Aug. 4, 2026

(54) PARALLEL-JETS COMBUSTION CHAMBER OF A TURBINE ENGINE

(71) Applicant: Prvni brnenska strojirna Velka Bites, a.s., Velka Bites (CZ)

(72) Inventors: Martin Beran, Prague (CZ); Libor Neklapil, Velka Bites (CZ)

(73) Assignee: Prvni brnenska strojirna Velka Bites, a.s. (CZ)

( * ) Notice: Subject to any disclaimer, the term of this patent is extended or adjusted under 35 U.S.C. 154(b) by 60 days.

(21) Appl. No.: 18/632,910

(22) Filed: Apr. 11, 2024

(65) Prior Publication Data

US 2025/0389422 A1 Dec. 25, 2025

(30) Foreign Application Priority Data

Apr. 12, 2023 (CZ) ..... CZ2023-139

(51) Int. Cl.
*F23R 3/52* (2006.01)

(52) U.S. Cl.
CPC ..... *F23R 3/52* (2013.01)

(58) Field of Classification Search
CPC ..... F23R 3/56; F23R 3/58; F23R 3/52; F23R 3/38
See application file for complete search history.

(56) References Cited

U.S. PATENT DOCUMENTS

| | | | | |
|---|---|---|---|---|
| 3,381,471 | A | 5/1968 | Szydlowski et al. | |
| 4,996,838 | A | 3/1991 | Melconian | |
| 2004/0045302 | A1* | 3/2004 | Brown | F02C 7/22 60/734 |
| 2007/0234733 | A1* | 10/2007 | Harris | F23R 3/38 60/776 |
| 2012/0111012 | A1* | 5/2012 | Axelsson | F23R 3/54 60/737 |
| 2012/0111014 | A1* | 5/2012 | Beran | F23R 3/04 60/758 |

* cited by examiner

*Primary Examiner* — Thuyhang N Nguyen
(74) *Attorney, Agent, or Firm* — OSTROLENK FABER LLP

(57) ABSTRACT

Parallel-jets combustion chamber of a turbine engine with an air inlet and an outer flame tube, and an inner flame tube. Oil is supplied into the chamber by a radial oil spray ring with inlet openings. The outer flame tube is conical and is continued at the front side by a front wall. Between the front end of the outer flame tube and the outer end of the end wall cooling openings for air are arranged. Between the inner end of the front wall and the oil spray ring an axial slot is provided for air supply. The thermally exposed end part of the lower wall of the combustion chamber is connected to an end portion of the inner flame tube (12). The lower wall is with the end portion connected in radial direction to form an annulus and inlet air openings are provided below the annulus.

1 Claim, 3 Drawing Sheets

PARALLEL-JETS COMBUSTION CHAMBER OF A TURBINE ENGINE

CROSS-REFERENCE TO RELATED APPLICATION

The present application claims priority to Czech Republic Application No. PV 2023-139, filed Apr. 12, 2023, the contents of which are incorporated herein by reference.

TECHNICAL FIELD

The invention relates to a parallel-jets combustion chamber with oil spray ring, it means with fuel and air flow in the same direction as is direction of the main air flow passing through the engine, particularly applicable for small turbine engines.

STATE OF THE ART

On some types of small jet, turbo shaft or turbo propeller engines currently an atomiser is used such as oil spray ring. All oil spray ring applications use a very similar combustion chamber construction. Such combustion chambers are typically characterized by a large height of primary zone in radial direction and by the absence of a stabilization vortex which would generate a backflow of hot gases into the primary zone, as it is the case by combustion chambers where fuel atomizers of the type of pressurized nozzle or Airblast type are built in from the front of combustion chamber. Here, the air flows in the primary zone only in radial direction and then leaves the combustion chamber in axially centred direction.

Document U.S. Pat. No. 3,381,471 discloses a combustion chamber where the air inlet is provided radially from above through a tube which is directed against an inner conical wall part, which is arranged partially in the combustion chamber and partially in the dilution space. Said part of the wall is shaped and positioned so that the gas is brought onto said conical part and it copies further the shape of the wall so as to form a vortex which leaves the combustion chamber towards the turbine. Fuel injection into the combustion chamber is provided by a oil spray ring on the inner diameter of the primary zone. Disadvantage of this combustion chamber is that the stabilization vortex is formed as far as in the secondary zone, not in the primary zone, so that the volume of the entire combustion chamber can be effectively utilised.

In document U.S. Pat. No. 4,996,838 a combustion chamber is disclosed which is formed as an array of multiple chambers, central of them are primary combustion chamber and secondary annular combustion chamber. Fuel injection is provided through an oil spray ring at the bottom on the inner side of the primary chamber. Inside the chambers only an anuloid vortex is produced, which is intended to prolong the residence time of the fuel-air mixture in the primary zone, but does not participate in any way in the flame stabilization.

The aim of the invention is to present a combustion chamber as compact as possible by using a suitable atomizer for injecting fuel into the combustion chamber in such a way as to induce a stabilization vortex of toroidal shape and thereby to achieve rapid preheating of the injected fuel, its vaporization and combustion by synchronised use of air for cooling walls of the flame tubes and the atomizer.

SUMMARY OF THE INVENTION

The above-mentioned shortcomings are eliminated by a parallel-jets combustion chamber of a turbine engine according to the characterising part of the claim 1.

DESCRIPTION OF DRAWINGS

The invention will now be explained by reference to the drawings in which.

DETAILED DESCRIPTION OF AN INVENTION

Figure 1:
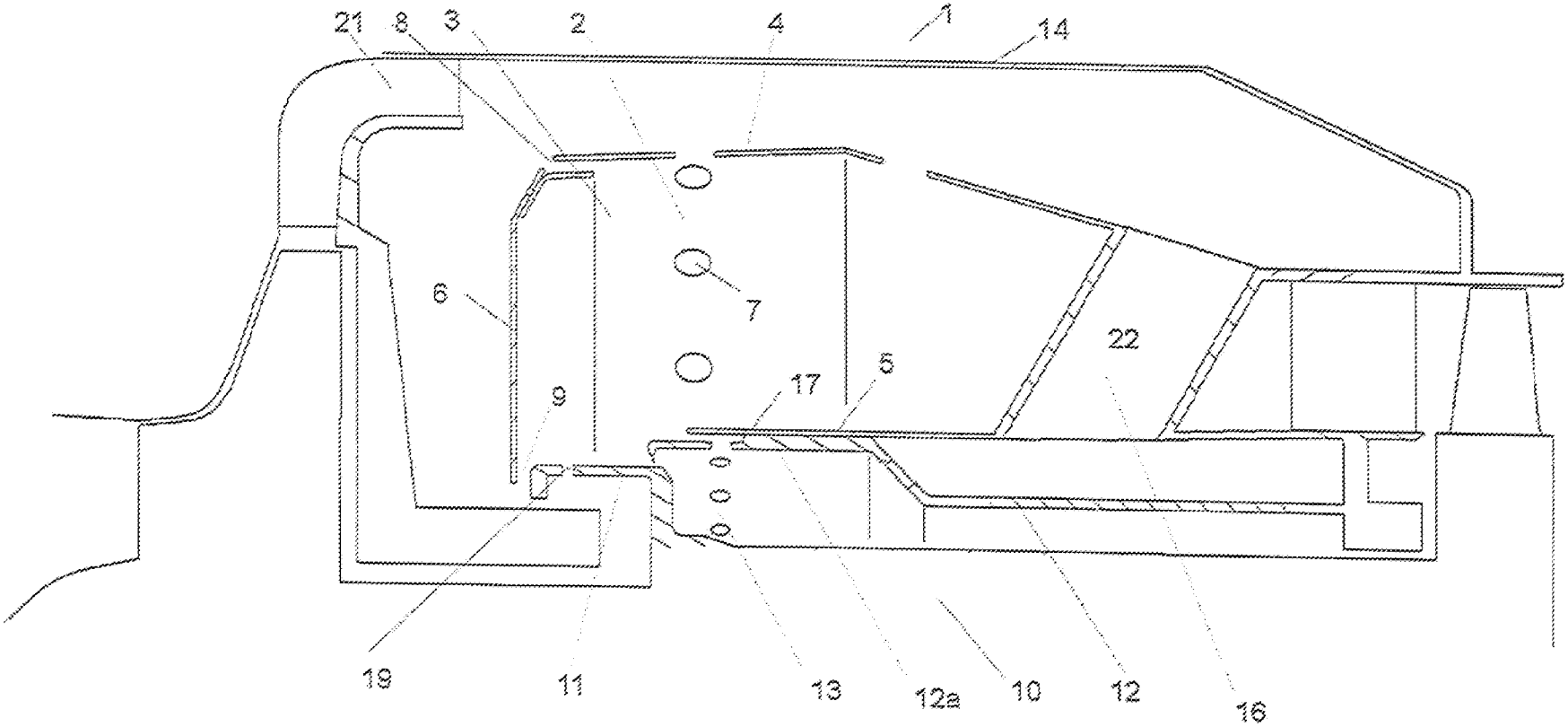
FIG. 1 is a longitudinal section through a half of a parallel-jets combustion chamber of a turbine engine according to the invention.

FIG. 1 is a longitudinal section through a half of a parallel-jets combustion chamber of a turbine engine according to the invention. A part of the turbine engine 1 with a casing 14 is shown, with the combustion chamber 2 provided inside. In the front part of the turbine engine 1, an unshown compressor is arranged on the main shaft 10 on the left in the figure, and on the right, in the rear part, an unshown turbine is also arranged on the shaft 10.

Combustion chamber 2 has an air inlet 21 under the front part of the casing 14. The combustion chamber 2 comprises an outer flame tube 4 which has a conical shape and is continued at the front side by a front wall 6 which is perpendicular in respect to the axial direction. Furthermore, the combustion chamber 2 is provided with an inner flame tube 12 having an end portion 12*a*. The outer flame tube 4 is conical in shape and comprises a set of openings 7 around the circumference of the conical casing in radial direction. Between the front end of the outer flame tube 4 and the outer end of the end wall 6 is arranged a set of cooling openings 8 for air arranged in the axial direction.

Between the end portion 12*a* of the inner flame tube 12 and the front wall 6 of the outer flame tube 4 a radial oil spray ring 11 is arranged. The oil spray ring 11 is provided with a set of radial inlet openings 19 for spraying fuel into the space of combustion chamber 2. An axial slot 9 for supply of cooling air is provided between the front wall 6 and the oil spray ring 11. All of the above-mentioned openings contribute to the formation of a toroidal stabilization vortex 15 in the primary zone 3 of the combustion chamber 2. The stabilization vortex 15 can be clearly seen in FIG. 2, where the direction of air flow is indicated by arrows, and then in FIG. 3, where the front part of the combustion chamber 2, in particular the primary zone 3 thereof, can be seen in detail.

Figure 2:
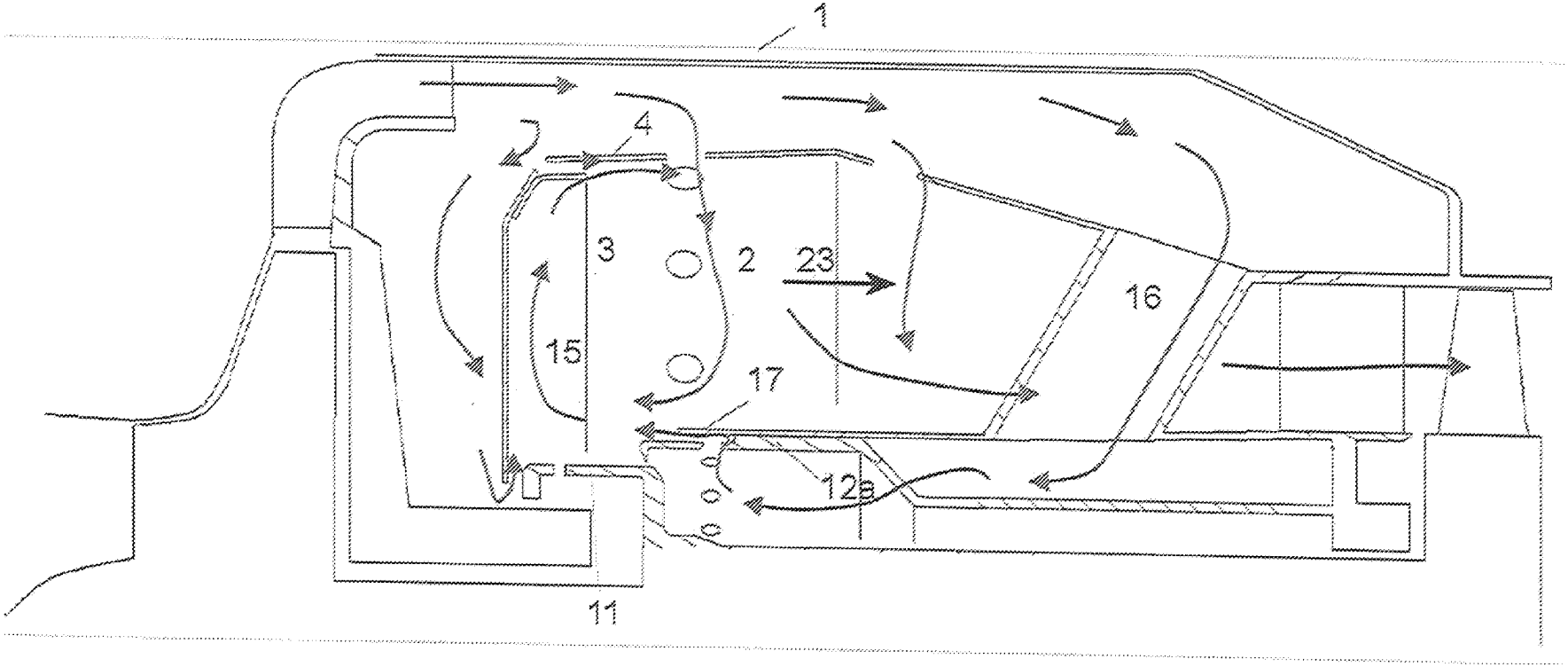
FIG. 2 is the combustion chamber of FIG. 1 with the airflow paths and directions indicated.
Figure 3:
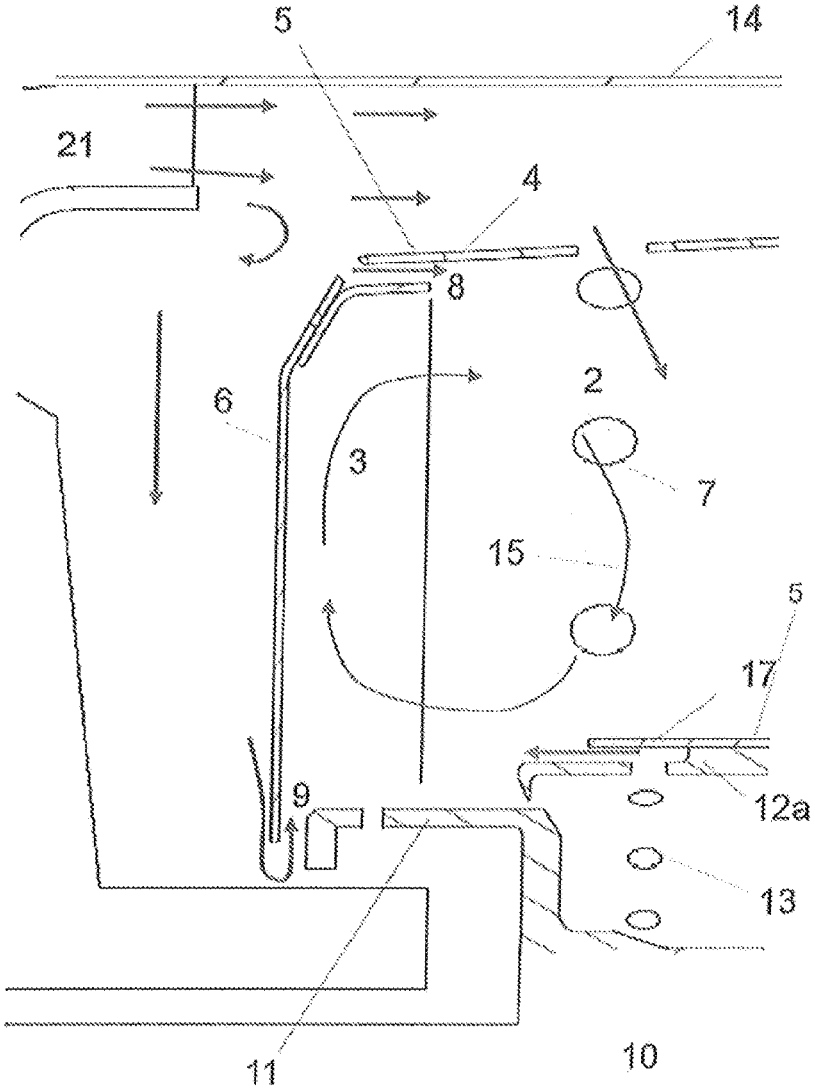
FIG. 3 is a detail of the combustion chamber of FIG. 1 in the space above the oil spray ring with the toroidal vortex indication.

The outer flame tube 4 is deliberately chosen in the shape of a cone. In such a way a sufficiently large cross-section between the outer flame tube 4 and the engine casing 14 is achieved, which helps to reduce the axial velocity. The air then flows through the set of openings 7 at a high angle in respect to the axis of the engine. The necessary penetration of the air into the main stream, indicated by the reference sign 23, see FIG. 2, is thus achieved, which contributes to the generation of the toroidal stabilization vortex 15. In a contrary, if sufficient penetration does not occur, the direction of air flow through the openings 7 in the outer flame tube 4 will remain dominantly in the axial direction and a compact toroidal vortex 15 will not be generated in the primary zone 3.

Figure 4:
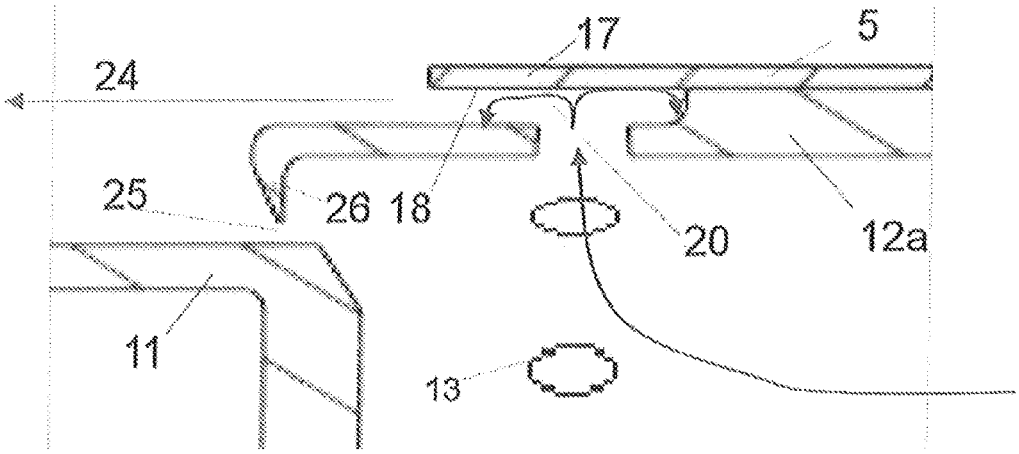
FIG. 4 is an even more magnified detail of the space above the oil spray ring and the detail of the space between the thermally exposed part of the combustion chamber and of the inner flame tube.

The inner flame tube 12 comprises a series of openings 13 in a radial direction arranged below the annulus 20, which is provided between the thermally exposed end part 17 of the lower wall 5 of the combustion chamber 2 and the end portion 12*a* of the inner flame tube 12. This is best illustrated in detail in FIG. 4. The thermally exposed end part 17 of the lower wall 5 of the combustion chamber 2 is connected to the end portion 12*a* of the inner flame tube 12, which extends over the thermally exposed end part 17. Air flows out of the annulus 20 in an axial direction, indicated by arrow 24, against the direction the main flow 23. The air which is passing through the series of openings 13 strikes the thermally exposed end part 17 of the lower wall 5 of the combustion chamber 2, which is connected to the end portion 12*a* of the inner flame tube 12, thereby locally producing an increase in the heat transfer coefficient on the bottom surface 18 of the thermally exposed end part 17.

Due to this cooling of the thermally exposed end portion 12*a* of the inner flame tube 12 is provided. The air is then discharged in the direction of the arrow 24 above the outer diameter of the oil spray ring 11. The air conducted in this way contributes to the formation of the toroidal vortex 15 and also protects the oil spray ring 11 from direct contact with hot gases, which would result in a serious reduction in the mechanical properties oil spray ring 11 material, and thus could threaten the maintenance of its integrity. In the same direction as indicated by the arrow 24, air also flows through the gap 25 between the edge 26 of the inner flame tube 12 and the oil spray ring 11. The main purpose of the gap 25 is to prevent, under all circumstances, contact between the rotating oil spray ring 11 and the cutting edge 26 of the inner flame tube 12. The resulting gap 25 then contributes to insulation of the oil spray ring 11 from hot gases in the primary zone 3.

On the rear side of the combustion chamber 2 straight stator blades 16 with a cavity 22 supplying air into the space between the inner flame tube 12 and the main shaft 10 are arranged. Due to the small size of the turbine engine and thus its components, it is not possible to design the turbine's distributor wheel with hollow blades of the required profile thickness to achieve the required flow capacity of both the air flowing into the space between the inner flame tube and the main shaft and the main jet path. Respectively, it is possible, but only at the cost of a large reduction in the density of blade grid of the distributor wheel of the turbine. This, however, substantially affects the desired resultant curl of the flowing flue gases in the circumferential direction, which is undesirable from the point of view of achieving the desired engine performance characteristics. For this reason, a separate wheel with straight stator blades 16 is used. This may be as a separate part into which the blades 16 are mounted or as a part of the inner flame tube 12 or the outer flame tube 4.

The cooling of the front wall 6 of the outer flame tube 4 is provided by the air supply through the axial slot 9. It is common practice to use the smallest possible radial slot between the oil spray ring and the wall of the outer flame tube. A system of openings in the front wall of the outer flame tube is then used to cool the outer flame tube wall. In addition, the space between the rear wall of the compressor and the outer flame tube is generally subjected to a lower pressure than the rest of the chamber.

Due to the low pressure gradient at that location, the air flow is usually unstable. In our case, an axial slot is used. Its setup is usually simplier and more stable during operation than a radial slot. In addition, when the air, flowing through the axial slot 9 contacts the intermediate ring of the front face of the rotating oil spray ring 11, kinetic energy is transferred through the friction of the air against the rotating surface of the oil spray ring 11, kinetic energy accelerates the air in the radial and circumferential directions. This will result in the formation of a uniform cooling film along the inner side of the front wall 6 of the outer flame tube 4. Thus, a relatively thin film is achieved which is capable of covering the entire front wall 6.

The present invention provides a compact combustion chamber 2 using a oil spray ring 11 for injecting fuel into the combustion chamber 2, whereby a stabilization vortex 15 of toroidal shape is formed, thereby achieving rapid preheating of the injected fuel, its vaporization and combustion by synchronised use of the air for cooling the walls of the flame tubes 4, 12 and of the oil spray ring 11.

LIST OF REFERENCE SIGNS

1 turbine engine
2 combustion chamber
3 primary zone
4 outer flame tube
5 lower wall of combustion chamber
6 front wall of the outer flame tube
7 outer flame openings
8 cooling openings in axial direction
9 axial slot
10 main shaft
11 oil spray ring
12 inner flame tube
12*a* end portion of the inner flame tube
13 inner flame tube openings
14 engine casing
15 toroidal stabilization vortex
16 straight stator blades with hollow profile
17 termally exposed end part
18 bottom surface of termally exposed part
19 inlet opening
20 annulus
21 air inlet
22 blade cavity
23 main airflow
24 axial direction of air flow
25 gap
26 edge

The invention claimed is:

1. Parallel-jets combustion chamber of a turbine engine having a casing, wherein in a front part of the turbine engine, a compressor is disposed on a main shaft and in a rear part of the turbine engine, a turbine is disposed on the main shaft, wherein the combustion chamber with a lower wall is disposed within a casing and comprises a primary zone with an air inlet and an outer flame tube and an inner flame tube, both of which are provided with air inlet openings for air inlet, wherein the lower wall has a thermally exposed end part adjacent the air inlet openings, wherein into the chamber, oil supply is provided by a radial oil spray ring arranged on the shaft with inlet openings for spraying fuel into the combustion chamber, wherein the outer flame tube has conical shape and is continued at a front side by a front wall, which is perpendicular to an axial direction, wherein between a front end of the outer flame tube and an outer end of an end wall, a set of cooling air openings for air is arranged in the axial direction, wherein between an inner end of the front wall and the oil spray ring, an axial slot is provided for the supply of air, wherein the thermally exposed end part of the lower wall of the combustion chamber is connected to an end portion of the inner flame tube, wherein in radial direction, an annulus is formed at the end portion and below the annulus a series of inlet tube openings for the air is arranged, wherein the end portion extends over the thermally exposed end part, wherein a front end of the end portion of the inner flame tube is provided with an edge and between the edge and the oil spray ring, a gap is provided, wherein sets of the air inlet openings around the circumference of the outer flame tube in a radial direction, series of inlet tube openings, the annulus, the gap and the axial slot are formed to generate a stabilization vortex of toroidal shape in the primary zone, wherein air which is passing through the series of inlet tube openings strikes the thermally exposed end part of the lower wall of the combustion chamber, which is connected to the end portion of the inner flame tube, thereby locally producing an increase in the heat transfer coefficient on the bottom surface of the thermally exposed end part.

* * * * *